US006203329B1

(12) United States Patent
Johnson et al.

(10) Patent No.: US 6,203,329 B1
(45) **Date of Patent: *Mar. 20, 2001**

(54) IMPEDANCE CONTROLLED INTERCONNECTION DEVICE

(75) Inventors: David A. Johnson, Wayzata; Eric V. Kline, Stillwater, both of MN (US)

(73) Assignee: JohnsTech International Corporation, Minneapolis, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/677,605

(22) Filed: Jul. 5, 1996

Related U.S. Application Data

(60) Provisional application No. 60/000,942, filed on Jul. 7, 1995.

(51) Int. Cl.[7] ..... H01R 12/00
(52) U.S. Cl. ..... 439/66; 439/608; 439/941
(58) Field of Search ..... 439/66, 608, 941, 439/69–71, 591

(56) References Cited

U.S. PATENT DOCUMENTS

| | | | | |
|---|---|---|---|---|
| 4,961,709 | * | 10/1990 | Noschese | 439/66 |
| 4,969,826 | * | 11/1990 | Grabbe | 439/66 |
| 5,066,236 | * | 11/1991 | Broeksteeg | 439/79 |
| 5,069,629 | | 12/1991 | Johnson | 439/71 |
| 5,169,320 | | 12/1992 | Burkett, Jr. et al. | 439/66 |
| 5,171,290 | | 12/1992 | Olla et al. | 439/71 |
| 5,207,584 | | 5/1993 | Johnson | 439/66 |
| 5,302,923 | | 4/1994 | Mason et al. | 333/33 |
| 5,309,630 | * | 5/1994 | Brunker et al. | 439/941 |

* cited by examiner

*Primary Examiner*—T. C. Patel
(74) *Attorney, Agent, or Firm*—Nawrocki, Rooney & Sivertson, P.A.

(57) ABSTRACT

An interconnection device for interconnecting a number of first terminals to a number of second terminals. The interconnection device includes a conductive housing and a number of contacts that are insulated from the conductive housing. This configuration may provide shielding to the number of contacts from outside sources of electro-magnetic interference. Further, a number of conductive ribs may be provided between adjacent contacts, thereby shielding the contacts from cross-talk interference between adjacent contacts. Finally, the impedance of each contact in the interconnection device may be controlled to provide a stable bandpass, and may be programmable to match, or correct for, the input impedance of a corresponding device.

24 Claims, 5 Drawing Sheets

IMPEDANCE CONTROLLED INTERCONNECTION DEVICE

CROSS-REFERENCE TO RELATED APPLICATIONS

This is a regular application filed under 35 U.S.C. § 111(a) claiming priority, under 35 U.S.C. § 119(e)(1), of provisional application Ser. No. 60/000,942, previously filed Jul. 7, 1995 under 35 U.S.C. § 111(b).

TECHNICAL FIELD

The present invention deals broadly with the field of devices for interconnecting electrical contacts. More narrowly, however, the invention is related to technology for inter-connecting a plurality of corresponding terminals by means of an electrical conductor between an integrated circuit device and a printed circuit board or between two printed circuit boards. The device is particularly useful for interfacing an integrated circuit with a tester, including a printed circuit board, during the manufacturing process to assure operativeness. The preferred embodiments of the present invention are directed to means for controlling the impedance and/or providing shielding to the interconnection between devices.

BACKGROUND OF THE INVENTION

Devices and methods for effecting electrical interconnection between two conductors are generally known. A specialized area of such interconnection has been recently expanding with the advent of integrated circuit technology. For example, in the manufacturing process for fabricating integrated circuit devices, each integrated circuit must be tested for operativeness. Thus, each lead of an integrated circuit device must be interconnected with a tester apparatus, wherein the tester apparatus may determine the functionality and performance of the corresponding integrated circuit device.

During such testing, an integrated circuit device is typically placed into an interconnect device (such as a test socket). The interconnect device interconnects each lead of the integrated circuit with a corresponding terminal of a printed circuit board. This may be accomplished with a number of contacts within the interconnect device. A tester apparatus is then electrically coupled to the printed circuit board such that the signals provided to each lead of the integrated circuit may be controlled and/or observed by the tester apparatus.

A further specialized area of interconnecting electrical contacts focuses on the interconnection of two printed circuit boards. These interconnections have applications utilizing insertable boards, such as memory cards, or multi-chip boards which are highly miniaturized and integrated.

Several technologies for packaging an integrated circuit chip into an semi-conductor package have been developed. These may be generally categorized as pin grid array (PGA) systems and leaded semi-conductor devices. The leaded semi-conductor devices include plastic leaded chip carriers (PLCC), dual in-line packages (DIP) and Quad Flat Pack (QFP). Each packaging type requires a particular array of leads to be interconnected with a printed circuit board.

A number of methods for connecting integrated circuits, such as PGA devices, with a printed circuit board are known. It is believed that limitations to these systems are the contact length and the usual requirement of mounting the contacts in through-holes located in a printed circuit board. The contact and through-hole mounting limits the mounting speed of the semi-conductor device while inducing discontinuities and impedance which cause signal reflections back to the source. Further, the design causes high lead inductance and thus problems with power decoupling and may result in cross-talk with closely adjacent signal lines.

Johnson recently disclosed in U.S. Pat. No. 5,069,629 (issued Dec. 3, 1991) and U.S. Pat. No. 5,207,584 (issued May 4, 1993) electrical interconnect contact systems which are directed to addressing both mechanical and electrical considerations of such systems. The disclosure of these references is incorporated herein by reference.

The disclosures of Johnson are directed to an interconnect device which comprises a generally planar contact which is received within one or more slots of a housing. In one embodiment, each contact is of a generally S-shaped design and supported at two locations (the hook portions of the S) by a rigid first element and an elastomeric second element. As disclosed, the Johnson electrical interconnect provides a wiping action which enables a good interface to be accomplished between the contact and the lead of the integrated circuit, and between the contact and terminals on a printed circuit board. Further, Johnson discloses an electrical contact that can sustain high operating speeds, and provides a very short path of connection. Such a contact may have low inductance and low resistance, thereby minimizing the impedance of the contact.

In recent years, the number of leads which may extend from one of the above referenced semi-conductor packages has substantially increased. Integrated circuit technology has allowed the integration of several complex circuits onto a single integrated circuit. Often, hundreds of thousands of gates may be incorporated into a single chip. A consequence of such integration is often a requirement that many input/output leads must extend from a corresponding semi-conductor package. To limit the overall dimensions of the semi-conductor package, the spacing between leads of many of the above referenced semi-conductor packages has decreased. As a result thereof, the spacing between the contacts of a corresponding interconnect device has also decreased.

The decrease in spacing between contacts of an interconnect device has necessarily increased the capacitance therebetween. Thus, a signal on a first contact of an interconnect device may affect the signal on a second contact of the interconnect device. This phenomenon is known as cross-talk. Cross-talk increases the noise on a contact, and thus adversely affects the reliability of the interconnect system.

Electromagnetic Interference (EMI) is another source of noise which reduces the reliability of interconnect systems. Typically, a low background level of EMI is present in the environment. Other, more obtrusive sources of EMI included IC testers, computers, test equipment, cellular phones, television and radio signals, etc. All of these sources of EMI should be considered when testing higher performance integrated circuits.

Another consideration of interconnect devices is the impedance provided by the corresponding contacts. It is recognized that the interconnect path between, for example, a semi-conductor package lead and a terminal on a printed circuit board, should have a relatively high and stable bandwidth across all applicable frequencies. That is, not only should the impedance of the interconnect system be minimized as disclosed in Johnson, but the impedance should also be controlled such that a relatively flat bandpass over all applicable frequencies exists.

To achieve a stable bandpass, it is often important to have a contact which provides impedance matching between a corresponding input of an integrated circuit and the corresponding driver. For example, if a tester is driving an input of an integrated circuit device via an interconnect device, it may be important for the interconnect device to provide an impedance such that the impedance of the driver matches the input impedance of the integrated circuit. Since the input impedance of the integrated circuit is often fixed, the impedance of the interconnect device may be used to correct for any impedance mismatch between the driver and the integrated circuit. Impedance matching may be important to minimize reflections and other noise mechanisms which may reduce the reliability and accuracy of the corresponding system.

Accordingly, a need exists for an improved electrical interconnect system to be utilized for interconnecting integrated circuit devices with printed circuit boards or for interconnecting multiple printed circuit boards. The interconnecting device should provide shielding for both cross-talk and EMI. The interconnect device should also allow the user to control and/or select the impedance for each contact provided therein.

SUMMARY OF THE INVENTION

The present invention addresses these needs as well as other problems associated with prior art electrical interconnect systems. The present invention provides an interconnect system whereby a number of contacts are shielded from outside sources of electro-magnetic interference by a conductive housing. Further, each of the contacts may be shielded from cross-talk interference between adjacent contacts by conductive ribs extending therebetween. Finally, the impedance of each contact in the interconnect system may be controlled to provide a stable bandpass, and the impedance may be programmable to match, or correct for, the input impedance of a corresponding device.

In an illustrative embodiment, the present invention provides an electrical interconnect between a number of first terminals and a number of second terminals. The present invention may include a housing, a number of contacts, and a number of insulating elements. Both the housing and the contacts are preferable made from a conductive material. The insulating elements may insulate the number of contacts from the housing. By providing an electrically conductive housing, the contacts may be shielded from outside sources of EMI. At the same time, however, because the contacts are electrically isolated from the housing, the contacts may maintain an independent interconnection between the number of first terminals and the number of second terminals.

An addition advantage of the present invention is that the impedance seen by the contacts is stabilized and controllable. In the present invention, a controlled impedance is created between the contacts and the conductive housing. By varying the geometry of the contacts and the insulating element, the impedance between the contacts and the housing can be programmed. This may provide a stable, and controllable, bandpass for the signals passing through the interconnection system.

In addition to the above, the present invention contemplates shielding the upper and lower portions of the contacts that extend above and/or below the conductive housing. It is contemplated that this may be accomplished in a number of ways, including providing a conductive skirt or gasket that is electrically coupled to the housing, and may extend toward the first and/or second terminals. The conductive skirt may shield the upper and/or lower portions of the contacts from electro-magnetic interference from outside sources. In addition, and to shield each of the contacts from cross-talk interference from adjacent contacts, it is contemplated that a number of ribs may be electrically coupled to the housing and may extend between adjacent contact. Selected ones of the number of ribs may extend above and/or below the top and/or bottom surfaces of the housing. The rib extensions may shield the top and/or bottom portions of the contacts from cross-talk interference. Further, when the first or second terminal is a device lead, the rib extensions may shield cross-talk interference between adjacent device leads, and between the device leads and adjacent contacts.

BRIEF DESCRIPTION OF THE DRAWINGS

In the drawings, in which like reference numerals indicate corresponding parts or elements of preferred embodiments of the present invention throughout the several views.

DETAILED DESCRIPTION OF THE INVENTION

Detailed embodiments of the present invention are disclosed herein. However, it is to be understood that the disclosed embodiments are merely exemplary of the present invention which may be embodied in various systems. Therefore, specific details disclosed herein are not to be interpreted as limiting, but rather as a basis for the claims and as a representative basis for teaching one of skill in the art to variously practice the invention.

Figure 1:
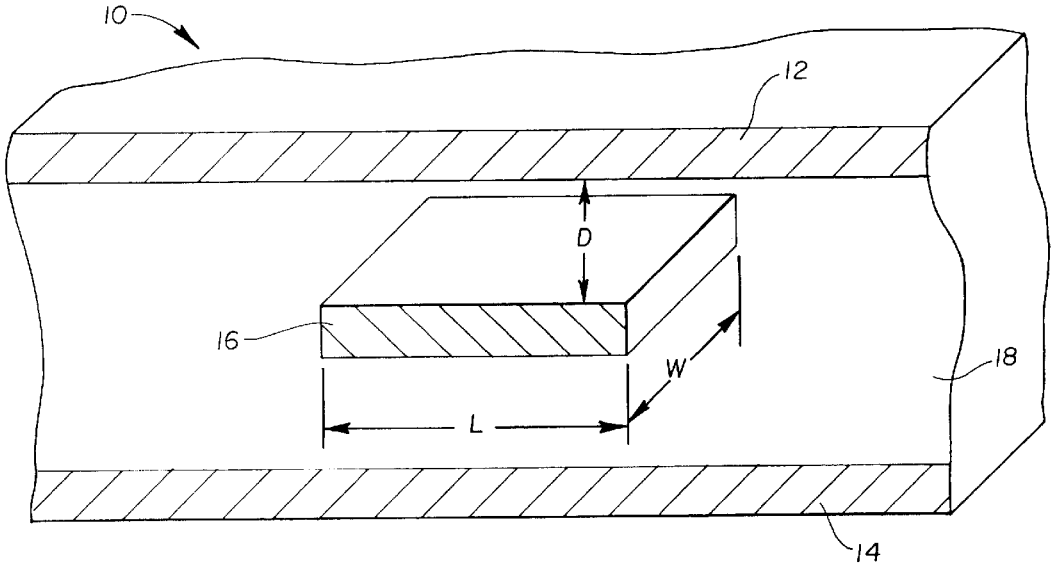
FIG. 1 is a fragmentary perspective view showing a conductor between two parallel plates.

FIG. 1 is a fragmentary perspective view showing a conductor between two parallel plates. The diagram is generally shown at 10. FIG. 1 generally shows the relationship between the physical characteristics of an electrical contact structure and the resulting impedance. A first plate 12 and a second plate 14 are shown extending substantially parallel to one another. A center plate 16 is disposed therebetween, wherein a dielectric or insulating material 18 is provided between the center plate 16 and the first and second plates 12, and 14.

For purposes of this discussion, it is assumed that center plate 16 is centered between first plate 12 and second plate 14. Thus, center plate 16 is positioned a distance "D" from first plate 12 and a same distance "D" from second plate 14. Center plate 16 has a length of "L" and a width of "W" as shown. Center plate 16, thus, has an area equal to "W" times "L". The capacitance between center plate 16 and first plate 12 is generally given by the formula:

$$C=\epsilon \cdot A/D$$

wherein A is the area of center plate 16, D is the distance between center plate 16 and first plate 12, and $\epsilon$ is the permittivity of dielectric 18. A similar formula can be found for the capacitance between center plate 16 and second plate 14. The corresponding impedance is generally expressed by the formula:

$$Z=1/(2\pi fC)$$

where f is the frequency.

It can readily be seen that the impedance can be affected by varying the area of center plate 16, the distance between center plate 16 and first plate 12 and/or second plate 14, and the permittivity of dielectric material 18.

Figure 2:
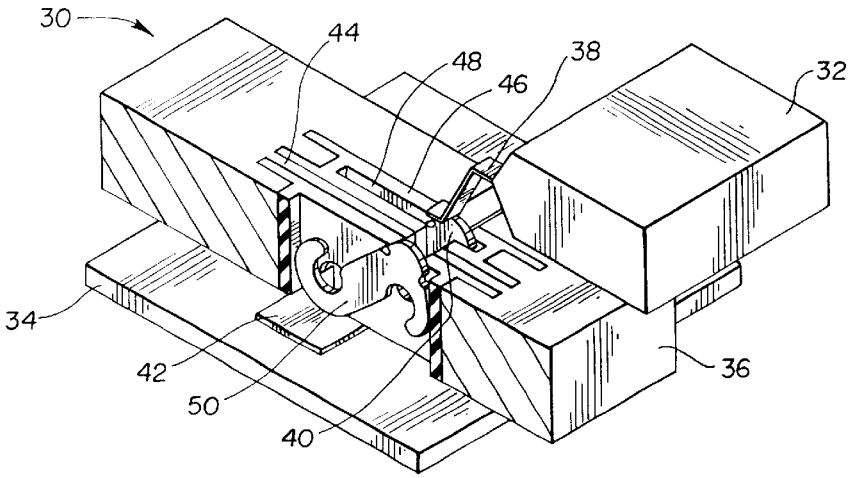
FIG. 2 is a perspective view with some parts cut away showing a first embodiment of the present invention in combination with an integrated circuit and a printed circuit board.

FIG. 2 is a perspective view with some parts cut away showing a first embodiment of the present invention in combination with an integrated circuit 32 and a printed circuit board 34. The drawing is generally shown at 30. Integrated circuit 32 has a lead 38 which may electrically engage an S-shaped contact element 40. A lower portion (not shown) of S-shaped contact element 40 may electrically engage a terminal 42 of printed circuit board 34. The S-shaped contact element 40 is disposed within a slot within a housing 36. The construction of the S-shaped contact and the corresponding housing assembly 36 are described in U.S. Pat. No. 5,069,629, issued to Johnson on Dec. 3, 1991, which is incorporated herein by reference. Although not specifically shown, it is contemplated that any size, shape or type of contact element may be used in conjunction with the present invention. This includes both rigid planer contact elements, deformable contact elements, or any other type of contact elements.

In the first embodiment of the present invention, housing 36 is manufactured from a conductive material such as aluminum. It is recognized, however, that housing 36 may be made from any conductive material. Housing 36 has a number of slots disposed therein, thereby forming a number of ribs therebetween. One such rib is shown at 44. In a preferred embodiment, the aluminum housing is manufactured from an aluminum blank. Each of the number of slots may be formed using an electro-discharge machining (EDM) process or a laser cutting process.

A sleeve 46 may be disposed in predetermined ones of the slots of housing 36. Each sleeve 46 may be manufactured from a dielectric or insulating material such as polytetrafluoroethylene. Polytetrafluoroethylene is sold under the registered trademark "TEFLON®" by Dupont Corporation. It is recognized, however, that any insulating material may be used to achieve the benefits of the present invention. It is further recognized that a user may select an insulating material which has a desired permittivity value, thereby providing the desired impedance characteristics to a corresponding contact element. It is contemplated that the sleeves may be constructed as separate elements, or may be an electrically insulative coating placed on the housing 36.

Each sleeve 46 may have a slot formed therein for receiving a corresponding contact. For example, sleeve 46 may have a slot 48 formed therein. Contact 40 may be disposed within slot 48 such that lead 38 may electrically engage an upper portion of contact 40 while terminal 42 may electrically engage a lower portion (not shown) of contact 40. Contact 40 may engage at least one elastomeric element as described in U.S. Pat. No. 5,069,629, issued to Johnson on Dec. 3, 1991.

Sleeve 46 may provide electrical isolation between contact 40 and housing 36. Further, sleeve 46 may be replaceable. This may be particularly useful after a predetermined amount of wear occurs between the sleeve 46 and contact 40 due to friction and other damage mechanisms.

Since housing 36 may be made from a conductive material, housing 36 may provide EMI shielding to contact 40. Further, it is contemplated that housing 36 may shield integrated circuit 32 from noise generated on, or by, traces on printed circuit board 34. Finally, rib 44 of housing 36 may minimize crosstalk between contact 40 and an adjacent contact 50.

It is contemplated that housing 36 may be grounded or otherwise electrically connected to a known voltage. In this configuration, the contact is surrounded by metal and an intervening dielectric, thereby yielding a strip-line structure. The geometries and certain other physical parameters thus define the impedance of the contact elements.

In another embodiment of the present invention, housing 36 may be formed from a plastic or other suitable dielectric or insulating material. Predetermined portions of housing 36 may then be coated or otherwise provided with a conductive surface. In a preferred embodiment, the inner surfaces of the ribs of housing 36 may be coated to minimize cross-talk between adjacent contacts. Further, it is contemplate that the top and side surfaces of housing 36 may be similarly coated to provide a shielding function. The conductive coating may be electrically coupled to ground.

An advantage of the embodiment shown in FIG. 2 is that the impedance of contact 40 is known and stabilized. In some prior art interconnect systems, the impedance of contact 40 may be dominated by stray capacitance and stray inductance, which may not terminate to a known voltage. The embodiment shown in FIG. 2 provides a ground plane and thus a majority of the impedance is terminated to ground. This may stabilize the bandpass of each contact up to the cutoff frequency thereof.

With reference to FIG. 1 and FIG. 2, housing 36 provides a first plate (or rib) 44 and a second plate (or housing) 36, with contact 40 disposed therebetween. The impedance, as seen by contact 40, is defined by the area of contact 40, the distance between contact 40 and rib 44 and housing 36, and the permittivity of sleeve 46. By varying these parameters, the impedance of contact 40 may be designed to match, or correct for, the input impedance of the corresponding input of integrated circuit device 32. In an illustrative embodiment, the distance between contact 40 and rib 44 is approximately 17 mils, but other distances are contemplated.

As indicated in U.S. Pat. No. 5,069,629, issued to Johnson, contact 40 is easily field replaceable. That is, each contact 40 may be removed and replaced with another contact. Thus, it is contemplated that a number of contacts, each having a different area, may be provided to a user along with a housing. The user may determine the input impedance of each input of a corresponding integrated circuit. The user may then provide an appropriate contact into each slot within housing 36 such that the impedance of each contact may match, or correct for, the input impedance of the corresponding inputs of the integrated circuit device. Thus, the user may: (1) determine the desired impedance of a contact element; (2) select a contact element that will result in the desired impedance; and (3) provide the contact selected in step (2) into a corresponding slot within a housing. In this way, a user may program the impedance of each contact within the interconnect device for each integrated circuit input to be tested.

Figure 3:
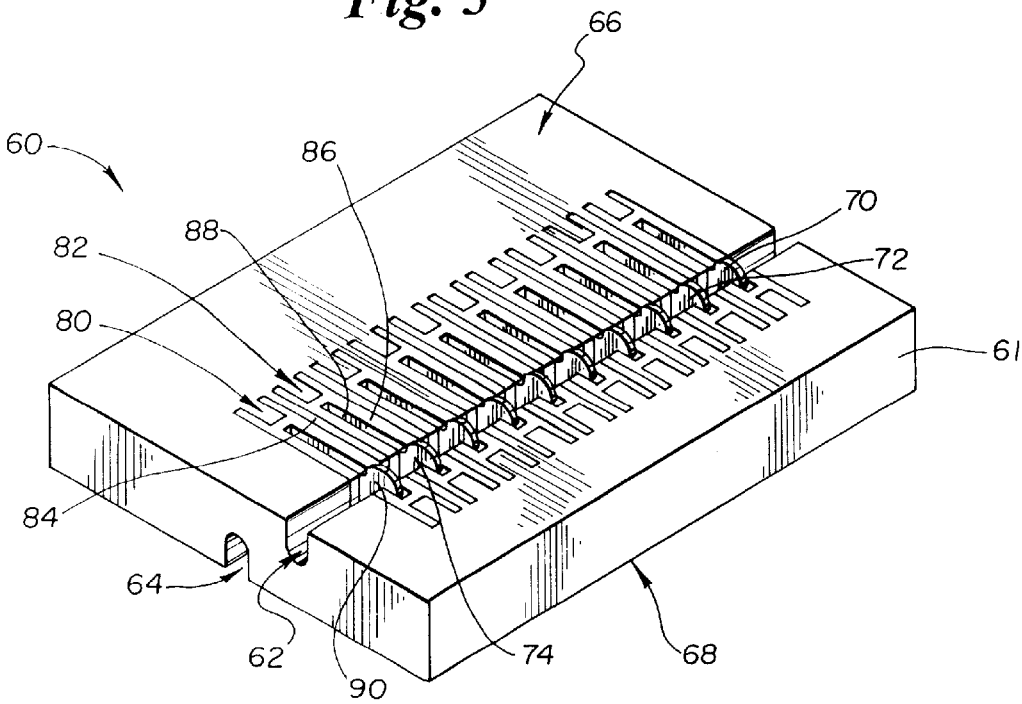
FIG. 3 is a perspective view showing a housing in accordance with the first embodiment of the present invention.

FIG. 3 is a perspective view showing a housing in accordance with the first embodiment of the present invention. The drawing is generally shown at 60. A housing 61 comprising an electrically conductive material is provided. In a preferred embodiment, housing 61 is manufactured from aluminum, but it is recognized that any conductive material may achieve similar results. Housing 61 may have a top surface 66 and a bottom surface 68 as shown. A number of slots, for example slots 80,82, may be formed though housing 61. Each of the slots 80,82 may extend from the top surface 66 through housing 61 to the bottom surface 68. As a result of forming the number of slots 80,82, a number of ribs may remain. For example, rib 84 may extend between slots 80 and 82. Each rib 84 may be electro-mechanically coupled to housing 61, thereby providing an electrical shield around the perimeter of slots 80 and 82.

A sleeve may be provided within each of the slots. For example, sleeve 86 may be provided in slot 82. It is contemplated that sleeve 86 may be manufactured from an insulating or dielectric material such as polytetrafluoroethylene. Each sleeve may have a slot formed therein for receiving a corresponding contact element. For example, sleeve 86 may have slot 88 formed therein for receiving a corresponding contact element.

A contact may then be provided in each slot of predetermined sleeves. For example, contact 74 may be provided within slot 88 of sleeve 86. In this configuration, sleeve 86 may electrically isolate contact 74 from housing 61. As indicated above, housing 61 may be electrically coupled to ground or to some other know voltage. Since housing 61 is made from a conductive material, housing 61 may provide EMI shielding to each of the contacts as shown. Further, the ribs of housing 61 may minimize crosstalk between adjacent contacts. Although not specifically shown, it is contemplated that any size, shape or type of contact element may be used in conjunction with the present invention. This includes both rigid planer contact elements, deformable contact elements, or any other type of contact elements.

Referring specifically to housing 61, a first trough 62 may be provided in the top surface 66 thereof extending in a downward direction therefrom. A second trough 64 may be provided in the bottom surface 68 thereof extending in an upward direction therefrom, wherein the first trough 62 is laterally offset from the second trough 64. A first support element (not shown) may be disposed in the first trough 62 and a second support element (not shown) may be disposed in the second trough 64. The first and second support elements may be made from a rigid or elastomeric material. Each of the number of contacts may engage the first and second support members. A further discussion of the contact support structure may be found in U.S. Pat. No. 5,069,629, issued to Johnson on Dec. 3, 1991.

In a preferred embodiment, one or both of the first and second support elements (not shown) are made from an elastomeric material. This allows each of the contact elements to move both laterally and vertically when engaged by a device lead. The movement of the contacts may provide a wiping action to both the leads of an integrated circuit and the terminals of a printed circuit board. The embodiment shown in FIG. 3 allows the desired contact motion while maintaining a relatively constant impedance.

The embodiment shown in FIG. 3 has the advantage that the impedance of each contact may be known and stabilized as described with reference to FIG. 2. Thus, it is contemplated that a number of contacts, each having a different area, may be provided to a user. The user may determine the input impedance of each input of a corresponding integrated circuit. The user may then select and provide an appropriate contact into each slot within housing 61 such that the impedance of each contact may match, or correct for, the input impedance of the corresponding inputs of the integrated circuit device. Thus, the user may: (1) determine the desired impedance of a contact element; (2) select a contact element that will result in the desired impedance; and (3) provide the contact selected in step (2) into a corresponding slot within a housing. In this way, a user may program the impedance of each contact within the interconnect device for each integrated circuit input to be tested.

Figure 4:
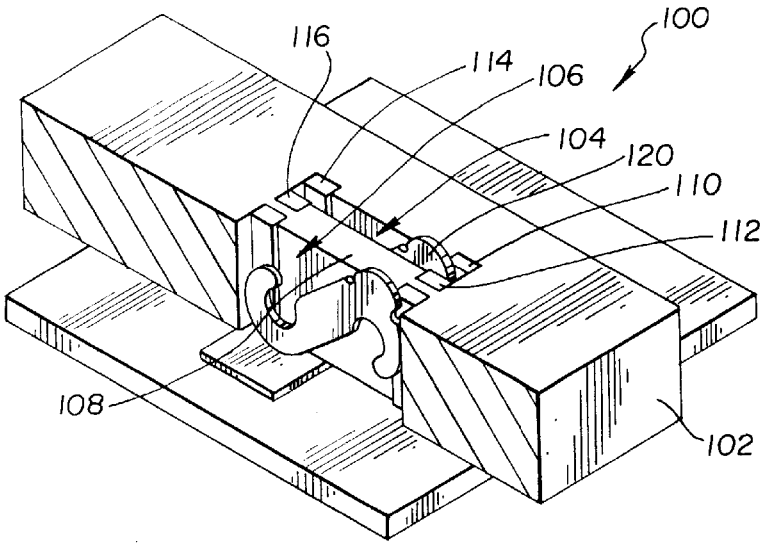
FIG. 4 is a perspective view with some parts cut away showing a second embodiment of the present invention in combination with a printed circuit board.

FIG. 4 is a perspective view with some parts cut away showing a second embodiment of the present invention in combination with a printed circuit board. The diagram is generally shown at 100. A housing 102 is provided. It is contemplated that housing 102 may be formed from an electrically conductive material. Although aluminum is the preferred material, it is recognized that any electrically conductive material may achieve similar results. Housing 102 may have a number of slots 104,106 formed therein. Each slot 104 and 106 may be separated by a rib 108. Rib 108 may be electro-mechanically coupled to housing 102. Each slot may have at least one spacing member 110 disposed therein. In the embodiment shown in FIG. 4, slot 104 has four spacing members 110, 112, 114, and 116 disposed therein. Each of the four spacing members 110, 112, 114, and 116 may be positioned in one of the four corners of slot 104. Thus, spacing member 110 is laterally spaced from spacing member 112. Similarly, spacing member 114 is laterally spaced from spacing member 116. In a preferred embodiment, spacing members 110, 112, 114, and 116 may be formed from polytetrafluoroethylene. It is recognized, however, that a user may select an insulating material which has a desired permittivity thereby providing the desired impedance characteristics to a corresponding contact element.

A contact 120 may be provided within slot 104 such that an upper portion of contact 120 is positioned between spacing members 110 and 112, and a lower portion of contact 120 is positioned between spacing members 114 and 116. In this configuration, contact 120 is prevented from electrically contacted a sidewall of slot 104. Furthermore, the dielectric material extending between contact 120 and rib 108 and housing 102 is substantially comprised of air, except for the portions of contact 120 which engage spacing members 110, 112, 114, and 116. It is known that air has a low permittivity value and therefore may minimize the capacitance between contact 120 and rib 108 and housing 102. This may increase the bandpass and/or cut-off frequency of contact 120.

Figure 5:
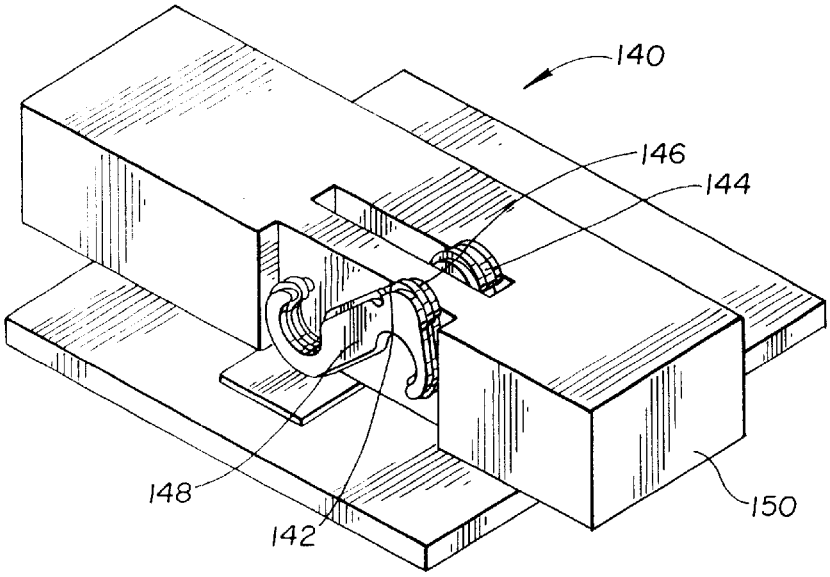
FIG. 5 is a perspective view with some parts cut away showing a third embodiment of the present invention in combination with a printed circuit board.

FIG. 5 is a perspective view with some parts cut away showing a third embodiment of the present invention in combination with a printed circuit board. The drawing is shown generally at 140. This embodiment is similar to the embodiment shown in FIG. 4 except the spacing members 110, 112, 114, and 116 are removed. Rather, each contact 142 and 144 may have an insulating layer provided directly on the lateral outer surfaces thereof. For example, contact 142 may have a first insulating layer 146 provided on a first surface thereof and a second insulating layer 148 on a second surface thereof. It is contemplate that the first and second insulating layers 146 and 148 may be provided on contact 142 via an adhesive, a deposition process, a subtractive process, or any other means. The first insulating layer 146 and the second insulating layer 148 may prevent contact 146 from electrically contacting housing 150. The same attendant advantages discussed above may be provided by this embodiment as well.

Figure 6:
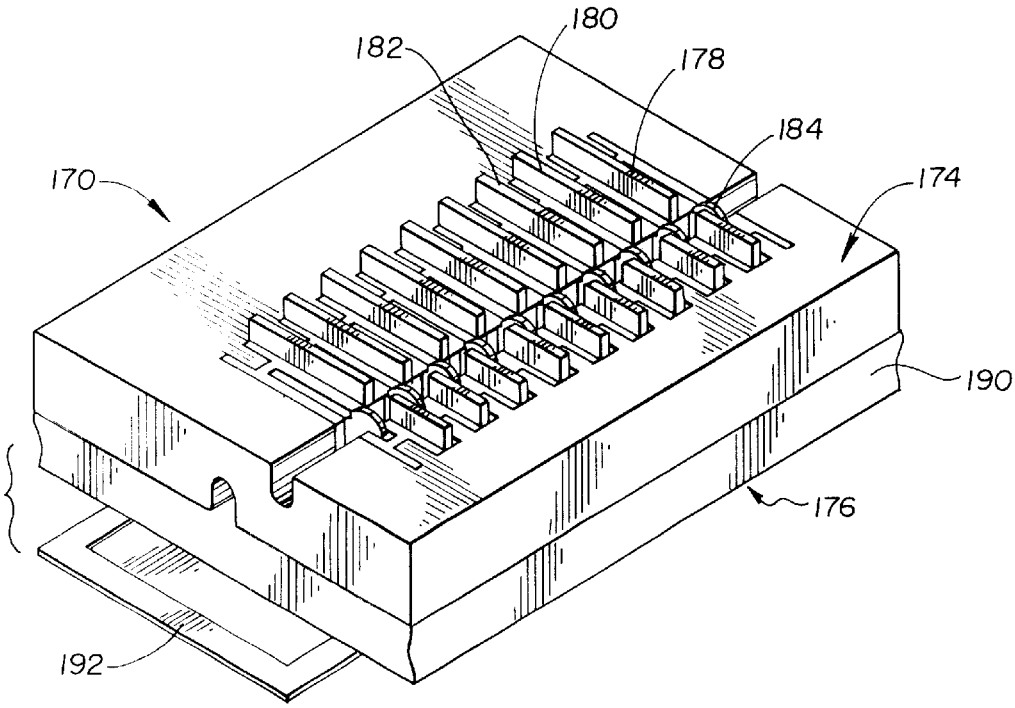
FIG. 6 is a perspective view showing a housing in accordance with the fourth embodiment of the present invention.

FIG. 6 is a perspective view showing a housing in accordance with a fourth embodiment of the present invention. The diagram is generally shown at 170. This embodiment is related to the first embodiment shown and describe with reference to FIG. 3. However, in this embodiment, it is contemplated that preselected ribs of the housing may extend upward beyond the top surface of the housing and toward a corresponding integrated circuit device as shown. For example, ribs 178, 180, and 182 may extend above top surface 174 of housing 172. As indicated above with reference to FIG. 2, a lead of an integrated circuit may electro-mechanically engage each of the contacts. For example, a lead of an integrated circuit may electro-mechanically engage contact 184. Thus, the lead of the integrated circuit may pass in between ribs 180 and 182. Ribs 180 and 182 may thus provide electromagnetic shielding to the top portion of contact 184 and to at least a portion of the corresponding lead (not shown). Further, the impedance matching effects discussed above may be applied to both the contact 184 and the corresponding lead (not shown).

Another feature of the embodiment shown in FIG. 6 is an EMI skirt provided along the bottom perimeter of housing 172. It is contemplated that a skirt 190 may be provided between housing 172 and a corresponding printed circuit board. Skirt 190 may be formed from any conductive material. However, in a preferred embodiment, skirt 190 may be formed from a wire mesh which may be compressed as housing 172 is brought into engagement with a corresponding printed circuit board (not shown). Skirt 190 may provide EMI shielding to the lower portion of the contacts and/or the terminals on the printed circuit board.

Another feature of the embodiment shown in FIG. 6 is a conductive gasket 192. It is contemplated that conductive gasket 192 may be provided between housing 172 and a corresponding printed circuit board. Conductive gasket 192 may be formed from any conductive material. In a preferred embodiment, however, conductive gasket 192 may be formed from a metallic material or a wire mesh. Conductive gasket 192 may provide EMI shielding to the lower portion of the contacts and/or the terminals on the printed circuit board. It is contemplate that skirt 190 and conductive gasket 192 may be used together or individually, depending on the particular application.

Figure 7:
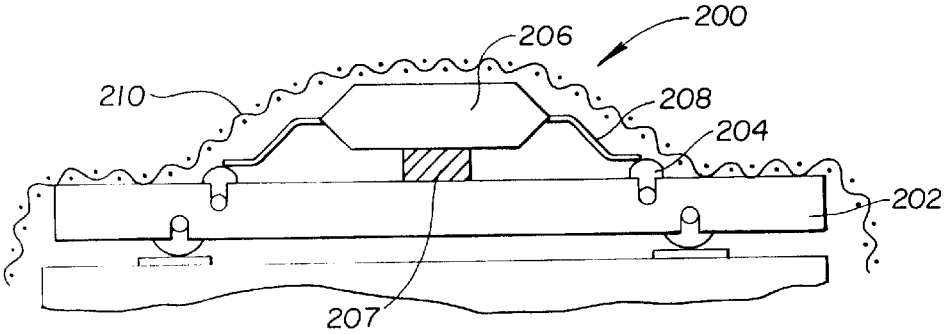
FIG. 7 is a side elevational view showing a housing in accordance with the first embodiment of the present invention with a wire mesh placed over the top surface thereof.

FIG. 7 is a side elevational view showing a housing in accordance with the first embodiment of the present invention with a wire mesh placed over the top surface thereof. The diagram is generally shown at 200. A housing 202 may be provided, wherein the housing may be made from a conductive material such as aluminum. It is recognized, however, that any conductive material may be used for housing 202.

As described with reference to FIG. 3, a number of contacts, for example contact 204, may be received within a number of slots. A sleeve may be provided in each of the number of slots within the housing 202. The construction of the contact, sleeve, and housing is further described with reference to FIG. 3.

An integrated circuit device 206 having a number of leads, may be brought into electro-mechanical engagement with the number of contacts of the interconnect device. For example, lead 208 of integrated circuit device 206 may be brought into electromechanical engagement with contact 204 of the interconnect device. The lower portion of selected contacts may be in electromechanical engagement with selected terminals on a printed circuit board. Thus, the interconnect device 200 may electro-mechanically couple a lead of integrated circuit device 206 with a corresponding terminal on a printed circuit board.

It is contemplated that an offset 207 may be positioned between housing 202 and integrated circuit device 206. In a preferred embodiment, offset 207 may be part of housing 202 and may be made from a conductive material. Since housing 202 may be grounded, offset 207 may provide a direct ground connection to integrated circuit device 206. This may be particularly useful when integrated circuit device 206 is packaged such that a ground plane thereof is positioned adjacent offset 207. Further, offset 207 may provide a thermal sink to integrated circuit device 206. Finally, offset 207 may provide a body stop to prevent damage to the leads 208 of integrated circuit 206 and to contacts 204.

In the embodiment shown in FIG. 7, a conductive mesh 210 may be provided over the top of integrated circuit device 206. The conductive mesh may be electrically connected to the outer periphery or other predefined portion of housing 202. It is contemplated that conductive mesh 210 may be a wire mesh. It is further contemplated that conductive mesh 210 may comprise a conductive cover or similar structure which is electrically coupled to housing 202. A purpose of conductive mesh 210 is to provide EMI shielding to the upper portion of the contacts, the leads of the integrated circuit device 206, and the integrated circuit device 206 itself.

The density of the wire mesh may vary depending on the particular application. For example, the density of the wire mesh may be lower if only relatively low frequency EMI is to be shielded. Conversely, the density of the wire mesh may be higher if relatively high frequency EMI is be shielded. Thus, the wire mesh may be designed to accommodate a wide variety of applications.

Figure 8A:
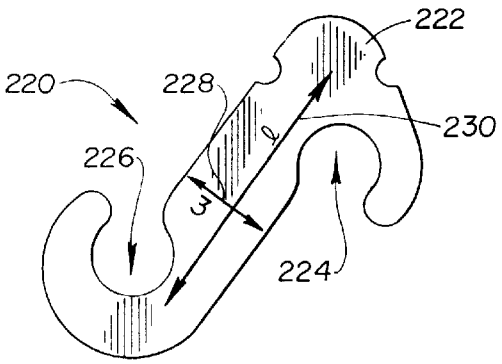
FIG. 8A is a perspective view of an S-shaped contact as used in the present invention.

FIG. 8A is a side perspective view of an S-shaped contact as used in the present invention. The diagram is generally shown at 220. In a preferred embodiment, a contact 222 is S-shaped and dimensioned such that a first hook portion 224 engages a first support member (not shown) and a second hook portion 226 engages a second support member (not shown). In a preferred embodiment, contact 222 is formed from a beryllium-copper alloy. A further discussion of the contact support structure may be found in U.S. Pat. No. 5,069,629, issued to Johnson on Dec. 3, 1991.

With reference to FIG. 1, the capacitance of a contact element is generally given by the formula $C=\epsilon \cdot A/D$. The area of contact 222 is defined by a contact length 230 and a contact width 228. In a preferred embodiment, the contact 222 is dimensioned to maintain the position of the first and second hook portions 224, 226. This may be necessary to allow the first and second hook portions 224, 226 to physically engage the first and second support members (not shown). In one embodiment, this may be accomplished by substantially maintaining the contact length 230. Thus, it is contemplated that the impedance of the contact element 222 may be varied by reducing the contact width 228 or varying other design parameters of contact 222.

It is contemplated that a number of contacts, each having a different area as described above, may be provided to a user. The user may determine the input impedance of each input of a corresponding integrated circuit. The user may then provide an appropriate contact into each slot within a housing such that the impedance of each contact may match, or correct for, the input impedance of the corresponding inputs of the integrated circuit device. Thus, the user may: (1) determine the desired impedance of a contact element; (2) select a contact element having the desired impedance; and (3) provide the contact selected in step (2) into a corresponding slot within a housing. In this way, a user may program the impedance of each contact within the interconnect device for each integrated circuit input to be tested.

It is further recognized that the distance from the contact to a corresponding rib may be varied to change the impedance of a corresponding contact. This may be accomplished by changing the thickness of the contact or providing a larger distance between adjacent ribs in the housing. Further, it is recognized that the permittivity of a corresponding sleeve may be varied by substituting various materials therefor to change the impedance of a corresponding contact. As indicated with reference to FIG. 4, it has already been disclosed that air may be used as an insulating material. Other materials are also contemplated.

Figure 8B:
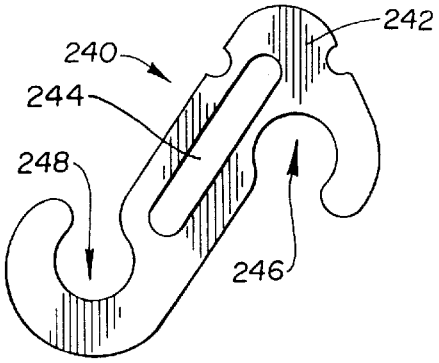
FIG. 8B is a perspective view of an S-shaped contact as used in the present invention with a predetermined portion removed therefrom.

FIG. 8B is a side perspective view of an S-shaped contact as used in the present invention with a predetermined portion removed therefrom. The diagram is generally shown at 240. A contact element 242 having a removed portion 244 may be provided. The removed portion 244 may reduce the overall area of contact element 242. As indicated with reference to FIG. 8A, it is preferred that the position of the first and second hook portions 246 and 248 remain relatively fixed because the first and second hook portions 246, 248 must physically engage the first and second support members (not shown). In the embodiment shown in FIG. 8B, the outer dimensions of contact element 242 are substantially the same as the outer dimensions of contact element 222 of FIG. 8A. The impedance of contact element 242 may be varied by removing a predetermined portion of contact element 242 as shown. It is contemplated that any portion of contact element 242 may be removed as long as the position of the first and second hook portions 246, 248 remains relatively fixed.

Figure 8C:
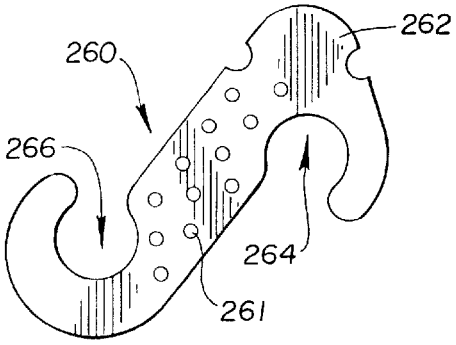
FIG. 8C is a perspective view of an S-shaped contact as used in the present invention with a number of predetermined portions removed therefrom.

FIG. 8C is a side perspective view of an S-shaped contact as used in the present invention with a number of predetermined portions 261 removed therefrom. The diagram is generally shown at 260 wherein a contact element 262 is shown. This embodiment is similar to the structure shown in FIG. 8B. However, rather than removing a single portion from the contact element, it is contemplated that a number of portions may be removed from contact element 262 as shown. This may reduce the overall area of contact element 262.

As indicated with reference to FIG. 8A, it is preferred that the position of the first and second hook portions 264 and 266 remain relatively fixed because the first and second hook portions 264, 266 must physically engage the first and second support members (not shown). In the embodiment shown in FIG. 8C, the outer dimensions of contact element 262 are substantially the same as the outer dimensions of contact elements 222 and 242. The impedance of the contact element 262 may be varied by removing a number of predetermined portions from contact element 262 as shown. It is contemplated that any number of portions may be removed from contact element 262 as long as the position of the first and second hook portions 264, 266 remains relatively fixed.

Figure 9A:
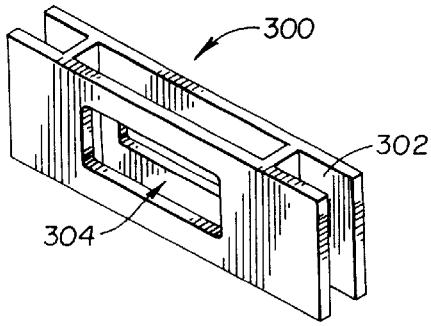
FIG. 9A is a perspective view of a sleeve as used in the first embodiment of the present invention with a predetermined portion removed therefrom.

FIG. 9A is a perspective view of a sleeve as used in the first embodiment of the present invention with a predetermined portion removed therefrom. The diagram is generally shown at 300. In a preferred embodiment, sleeve 302 is positioned within a corresponding slot within a housing. Since it is contemplated that the slots in the housing may be uniformly dimensioned, it is desired that each sleeve 302 have the same outer dimensions.

With reference to FIG. 1, the capacitance of a contact element is given by the formula $C=\epsilon \cdot A/D$. The sleeve 302 may be made from an insulating material having a preselected permittivity. Thus, the impedance of a contact element may be varied by changing the permittivity of the dielectric or insulating material which is disposed between the contact element and the housing. In the embodiment shown in FIG. 9A, a portion 304 may be removed from sleeve 302. Thus, the permittivity of the area between the contact element and the housing is defined by the insulating material for part of the contact area, and defined by air for the remaining contact area. By dimensioning the portion 304 that is removed from sleeve 302, a desired impedance may be selected for each contact in the interconnect device.

It is contemplated that a number of sleeves, each having a different sized removed portion, may be provided to a user. The user may determine the input impedance of each pin of a corresponding integrated circuit. The user may then insert an appropriate sleeve into each slot of the housing such that the impedance of each contact may match, or correct for, the input impedance of the corresponding inputs of the integrated circuit device. Thus, the user may: (1) determine the desired impedance of a contact element; (2) select a sleeve that will result in the desired impedance; and (3) provide the sleeve selected in step (2) into a corresponding slot within a housing. In this way, a user may program the impedance of each contact within the interconnect device for each integrated circuit input to be tested.

Figure 9B:
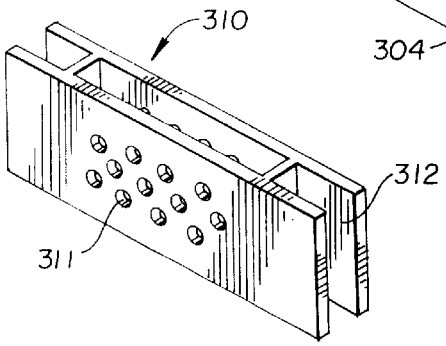
FIG. 9B is a perspective view of a sleeve as used in the first embodiment of the present invention with a number of predetermined portion removed therefrom.

FIG. 9B is a perspective view of a sleeve as used in the first embodiment of the present invention with a number of predetermined portions removed therefrom. The diagram is generally shown at 310 wherein a sleeve 312 is shown. This embodiment is similar to FIG. 9A. However, rather than removing a single portion from the sleeve, a number of predetermined portions 311 may be removed, as shown.

Figure 10:
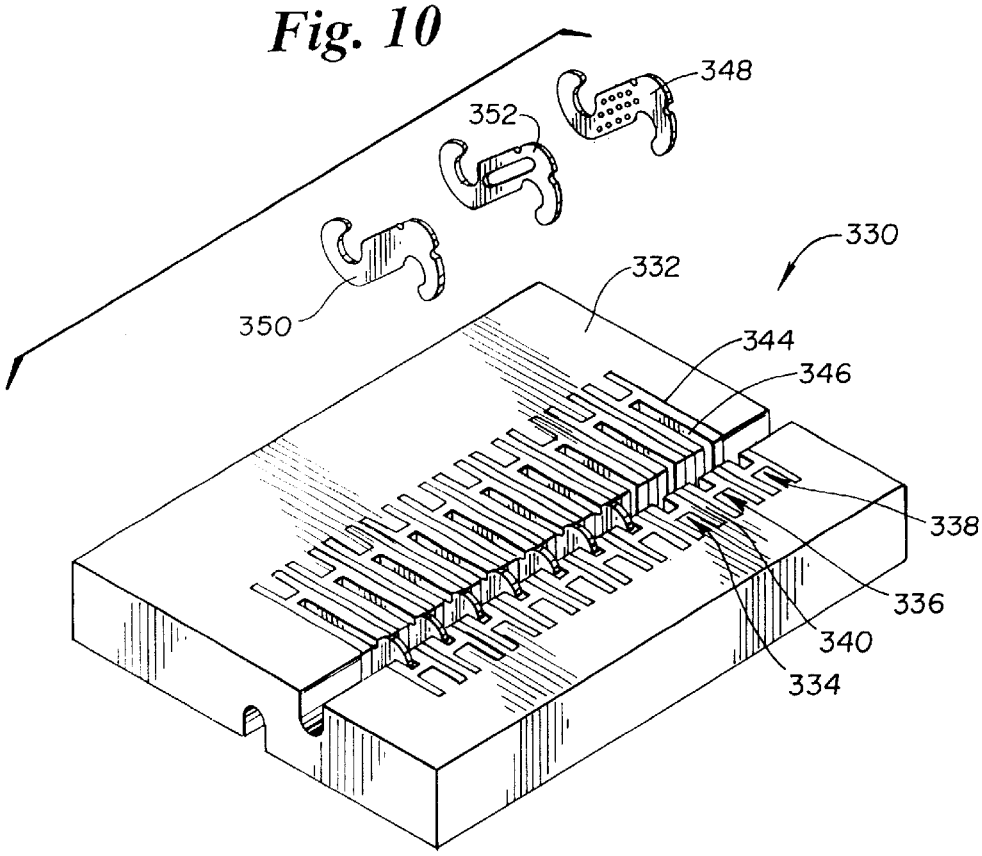
FIG. 10 is a perspective view showing a housing in accordance with the first embodiment of the present invention, wherein a number of S-shaped contacts having varying impedance characteristics are preselected and placed within corresponding slots within the housing.

FIG. 10 is a perspective view showing a housing in accordance with the first embodiment of the present invention, wherein a number of S-shaped contacts having varying impedance characteristics are preselected and inserted within corresponding slots within the housing. The diagram is generally shown at 330. A housing 332 comprising an electrically conductive material is provided and is substantially similar to that shown and described with reference to FIG. 3. A number of slots, for example slots 334,336, and 338, may be formed though housing 332. As a result of forming the number of slots 334,336, and 338, a number of ribs remain therebetween. For example, rib 340 may extend between slots 334 and 336. Each rib 340 is electro-mechanically coupled to housing 332, thereby providing an electrical shield around the perimeter of each of the slots.

A number of sleeves may be provided within each of the slots. For example, sleeve 344 may be provided in slot 338. It is contemplated that sleeve 344 may be manufactured from an insulating or dielectric material. Each sleeve may have a slot formed therein for receiving a corresponding contact element. For example, sleeve 344 may have slot 346 formed therein for receiving a corresponding contact element 348.

A preselected contact may then be provided within each of the slots of the number of sleeves. For example, contact 348 may be provided within slot 346 of sleeve 344. In this configuration, sleeve 344 electrically isolates contact 346 from housing 332. In a preferred embodiment, housing 332 is electrically coupled to ground or to some other known voltage. Since housing 332 is made from a conductive material, housing 332 may provide EMI shielding to each of the contacts therein. Further, the ribs of housing 332 may minimize crosstalk between adjacent contacts.

Referring specifically to the embodiment shown in FIG. 10, it is contemplated that a number of contacts 348,350, 352, each having a different area and thus a different impedance characteristic, may be provided to a user of the interconnect device. The user may determine the input impedance of each input of a corresponding integrated circuit. The user may then provide an appropriate contact, as shown, into each slot within housing 332 such that the impedance of each contact may match, or correct for, the input impedance of the corresponding inputs of the integrated circuit device. Thus, the user may: (1) determine the desired impedance of a contact element; (2) select a contact element that will result in the desired impedance; and (3) provide the contact selected in step (2) into a corresponding slot within the housing. In this way, a user may program the impedance of each contact within the interconnect device for each integrated circuit input to be tested.

It is further contemplate that the user may: (1) determine the desired impedance of a contact element; (2) select a sleeve that will result in the desired impedance; and (3) provide the sleeve selected in step (2) into a corresponding slot within a housing. In this way, a user may program the impedance of each contact within the interconnect device for each integrated circuit input to be tested.

Finally, it is contemplated that a user may: (1) determine the desired impedance of a contact element; (2) select a sleeve and contact combination that will result in the desired impedance; and (3) provide the sleeve and contact combination selected in step (2) into a corresponding slot within a housing. This may provide additional flexibility in achieving the desired contact impedance.

New characteristics and advantages of the invention covered by this document have been set forth in the foregoing description. It will be understood, however, that this disclosure is, in many respects, only illustrative. Changes may be made in details, particularly in matters of shape, size, and arrangement of parts, without exceeding the scope of the invention. The scope of the invention is, of course, defined in the language in which the appended claims are expressed.

What is claimed is:

1. Apparatus for electrically interconnecting a first terminal to a second terminal and controlling impedance of the interconnection, comprising:

(a) a housing having a portion which is electrically conductive, said housing having a number of slots formed therein;

(b) a sleeve provided in a preselected one of said number of slots of said housing and having a portion which is electrically insulative, said sleeve forming a contact receiving slot; and (c) a contact selected from a plurality of contacts having different areas and disposed in said contact receiving slot formed by said sleeve, at least a portion of said contact being electrically conductive, and said sleeve electrically insulating the portion of said contact that is electrically conductive of said contact from the portion of said housing that is electrically conductive;

(d) whereby when said first terminal and said second terminal engage said contact, said contact electrically connecting said first terminal to said second terminal;

(e) wherein a portion of a wall defining said sleeve overlying said contact is removed to define at least one aperture, said sleeve in combination with said selected contact effecting serial matching of impedance along a connection of said first terminal to said second terminal through said contact.

2. Apparatus according to claim 1 wherein said housing has an outer surface, and a portion of said outer surface is formed from a conductive material.

3. Apparatus according to claim 2 wherein said entire housing is formed from a conductive material.

4. Apparatus according to claim 1 wherein said sleeve is of a singular construction.

5. Apparatus according to claim 1 wherein said sleeve comprises a number of spacing members.

6. Apparatus according to claim 1 wherein said contact has a number of holes therein.

7. Apparatus according to claim 1 wherein said housing includes a first slot and a second slot, and the first slot is located adjacent to the second slot with a rib extending therebetween.

8. Apparatus according to claim 7 wherein at least a portion of said rib is electrically conductive.

9. Apparatus according to claim 8 wherein said portion of said rib that is electrically conductive is electrically coupled to said housing.

10. Apparatus according to claim 9 wherein said rib has a first surface forming part of said first slot and a second surface forming part of said second slot.

11. Apparatus according to claim 10 wherein at least a portion of said first surface of said rib is electrically conductive.

12. Apparatus according to claim 10 wherein at least a portion of said first surface is coated with a conductive material.

13. Apparatus according to claim 11 wherein at least a portion of said second surface of said rib is electrically conductive.

14. Apparatus according to claim 12 wherein at least a portion of said surface is coated with a conductive material.

15. Apparatus according to claim 7 wherein said housing has a top surface and a bottom surface, and said first and second slots extend between said top surface and said bottom surface.

16. Apparatus according to claim 15 wherein said rib extends upward from said top surface of said housing.

17. Apparatus according to claim 1 wherein said housing includes a top surface and a bottom surface, wherein the top surface is adjacent the first terminal and the bottom surface is adjacent the second terminal.

18. Apparatus according to claim 17 further comprising an electrically conductive skirt, wherein said electrically conductive skirt is electrically coupled to said housing and extends downwardly from said bottom surface of said housing toward said second terminal.

19. Apparatus according to claim 18 wherein said second terminal is a conductive pad on a printed circuit board.

20. Apparatus according to claim 19 wherein said skirt extends downwardly from said bottom surface of said housing and to said printed circuit board.

21. Apparatus according to claim 17 further comprising an electrically conductive gasket, wherein said electrically conductive gasket is electrically coupled to said housing and extends downwardly from said bottom surface of said housing toward said second terminal.

22. Apparatus according to claim 17 further comprising a conductive skirt, wherein said conductive skirt is electrically coupled to said housing and extends upwardly from said top surface of said housing toward said first terminal.

23. Apparatus according to claim 22 wherein said second terminal is a device lead of a device package.

24. Apparatus according to claim 23 wherein said conductive skirt extends upwardly from said top surface of said housing and around said device package.

* * * * *